United States Patent [19]

Ohe et al.

[11] Patent Number: 4,804,966

[45] **Date of Patent: * Feb. 14, 1989**

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[ * ] Notice: The portion of the term of this patent subsequent to Nov. 17, 2004 has been disclaimed.

[21] Appl. No.: 792,010

[22] Filed: Oct. 28, 1985

[30] Foreign Application Priority Data

Oct. 29, 1984 [JP] Japan ..... 59-228783
Oct. 29, 1984 [JP] Japan ..... 59-228784

[51] Int. Cl.[4] ..... H01Q 1/32
[52] U.S. Cl. ..... 343/712; 343/842
[58] Field of Search ..... 343/711–713, 343/741, 744, 873, 866, 789, 842, 841, 743

[56] References Cited

U.S. PATENT DOCUMENTS

| | | | |
|---|---|---|---|
| 2,200,674 | 5/1940 | McDonald | 343/866 |
| 2,212,253 | 8/1940 | Stief | 343/711 |
| 2,404,093 | 7/1946 | Roberts | 343/708 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,923,813 | 2/1960 | Davis | 343/712 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/712 |
| 3,210,766 | 10/1965 | Parker | 343/712 |
| 3,364,487 | 1/1968 | Maheux | 343/702 |
| 3,611,388 | 10/1971 | Okumura | 343/712 |
| 3,717,876 | 2/1973 | Volkers et al. | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/712 |
| 4,003,056 | 6/1977 | Davis | 343/712 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |
| 4,707,701 | 11/1987 | Ohe et al. | 343/712 |

FOREIGN PATENT DOCUMENTS

| | | |
|---|---|---|
| 0182497 | 10/1985 | European Pat. Off. . |
| 0181120 | 5/1986 | European Pat. Off. . |
| 0181200 | 5/1986 | European Pat. Off. . |

(List continued on next page.)

OTHER PUBLICATIONS

Japanese Pat. Abstract, vol. 6, No. 37 E-97, Mar. 6, 1982, 56-156031.

Japanese Pat. Abstract, vol. 6, No. 55 E-101, Apr. 10, 1982, 56-168441.

(List continued on next page.)

*Primary Examiner*—William L. Sikes
*Assistant Examiner*—Michael C. Wimer
*Attorney, Agent, or Firm*—Cushman, Darby & Cushman

[57] ABSTRACT

The present invention provides an automobile antenna system capable of receiving radio waves without need of an externally projecting part such as a pole type antenna externally exposed from the vehicle body, the automobile antenna system including a high-frequency pick-up disposed on the marginal portion of an engine hood or trunk lid on the vehicle body such that the length of the pick-up is parallel to the longitudinal axis of the engine marginal edge of the engine hood or trunk lid, whereby surface high-frequency currents induced on the vehicle body by radio waves and concentrically flowing on the marginal portion of the engine hood or trunk lid can be detected by the pick-up.

5 Claims, 15 Drawing Sheets

FOREIGN PATENT DOCUMENTS

| | | |
|---|---|---|
| 0181765 | 5/1986 | European Pat. Off. . |
| 0183523 | 6/1986 | European Pat. Off. . |
| 0183520 | 6/1986 | European Pat. Off. . |
| 889618 | 7/1949 | Fed. Rep. of Germany . |
| 1131762 | 8/1958 | Fed. Rep. of Germany . |
| 7015306 | 4/1970 | Fed. Rep. of Germany . |
| 1949828 | 4/1970 | Fed. Rep. of Germany . |
| 2425189 | 5/1974 | Fed. Rep. of Germany . |
| 2701921 | 7/1978 | Fed. Rep. of Germany . |
| 2733478 | 2/1979 | Fed. Rep. of Germany . |
| 2745475 | 4/1979 | Fed. Rep. of Germany . |
| 2821202 | 11/1979 | Fed. Rep. of Germany . |
| 2231124 | 5/1974 | France . |
| 53-22418 | 7/1978 | Japan . |
| 53-34826 | 8/1978 | Japan . |
| 5346617 | 4/1980 | Japan . |
| 129464 | 2/1984 | Japan . |
| 59-44861 | 3/1984 | Japan . |
| 9195811 | 12/1984 | Japan . |
| 60-1008 | 1/1985 | Japan . |
| 60-1009 | 1/1985 | Japan . |
| 60-1010 | 1/1985 | Japan . |
| 60-1011 | 1/1985 | Japan . |
| 60-1012 | 1/1985 | Japan . |
| 60-175221 | 10/1985 | Japan . |

OTHER PUBLICATIONS

Japanese Pat. Abstract, vol. 7, No. 162, E-187, Jul. 15, 1983, 58070640 and 58070642.

German article entitled "UKW-Rundfunkempfang im Auto" by Lindenmeier and Meinke dated 1977 Funkschau, pp. 40, 44, 715-717.

Abstract of 55-88407, Japan, 7/4/1980.

Abstract of 60-169204, Japan, 9/2/1985.

Abstract of 60-172804, Japan, 9/6/1985.

AUTOMOBILE ANTENNA SYSTEM

BACKGROUND OF THE INVENTION

1. Field of the Invention

The present invention relates to an improved antenna system for automobiles which can efficiently detect radio waves received by the vehicle body and transmit the detected signals to various built-in receivers within the vehicle body.

2. Description of the Prior Art

In modern automobiles, it is essential to have antenna systems for positively receiving various broadcast (radio and TV) or communication (car-telephone and others) waves at their built-in receivers. Moreover, such antenna systems also are important, for example, for citizen band tranceivers which are adapted to effect the transmission and reception of waves between the automobile and other stations.

In the prior art, there is generally known a pole type antenna which projects outwardly from the vehicle body and which exhibits good reception performance.

However, such a pole type antenna is actually subject to being damaged or stolen and also produces an unpleasant noise when an automobile on which the pole type antenna is mounted runs at high speeds. It has been desired to eliminate such a pole type antenna from the vehicle body.

In recent years, frequency bands of radio or communication waves to be received at vehicles are being increased so as to require a plurality of antenna systems accommodating various frequency bands This not only damages the aesthetics of the vehicle, but also reduces reception performance due to electrical interference between the antennas.

Some attempts have been made which eliminate or conceal the pole type antenna. One such attempt is to apply an antenna wire, for example, to the rear window glass of an automobile.

Another proposal has been made in which surface currents induced on the vehicle body by radio waves are detected. Although it appears that such a proposal is apparently positive and advantageous in efficiency, it exhibited unexpectable and undesirable results and thus was not widely used in the prior art.

There are some reasons why surface currents induced on the vehicle body by radio waves were not generally utilized. One of these reasons is that the level of the surface currents is not as high as expected. The prior art mainly utilizes surface currents induced on the vehicle body at its roof panel. Such surface currents provides a level of detection output insufficient to be utilized.

The second reason is that noise is included in the surface currents in a very large proportion. The noise results mainly from the ignition and regulator systems of an engine and therefore cannot be eliminated unless the engine is stopped.

Japanese Patent Publication Sho No. 53-22418 shows an antenna system utilizing currents induced on the vehicle body by radio waves. The antenna system comprises an electrical insulation on the vehicle body at a location on which the currents flow concentrically. Between the opposite ends of the electrical insulation, the currents are detected directly by a sensor. This prior art antenna system provides practicable detection signals having a superior S/N ratio, but requires a pick-up device which must be located in a cut-out portion on the vehicle body. Therefore, it is not suitable for use in modern automobiles which are manufactured by the mass-production system.

Japanese Utility Model Publication Sho No. 53-34826 discloses an antenna system including a pick-up coil for detecting currents flowing on the vehicle body at its pillar. Such an antenna system is advantageous in that the antenna is housed in the vehicle body. However, it is not practical since the pick-up coil must be disposed adjacent to the pillar in a direction perpendicular to the length of the pillar. Furthermore, such an arrangement does not provide any practical antenna output.

As seen from the foregoing, the prior art does not provide an antenna system having a pick-up construction or arrangement which can efficiently detect currents induced on the vehicle body by radio waves and obtain a practical S/N ratio. Rather, various experiments showed that it is impossible to use the principle of an antenna system utilizing currents on the vehicle body.

SUMMARY OF THE INVENTION

It is therefore an object of the present invention to provide an improved antenna system for small-sized automobiles, which can more efficiently detect currents induced on the vehicle body by radio waves and transmit them to built-in receivers in the same vehicle body.

For this end, the present invention provides an antenna system comprising a high-frequency pick-up disposed in close proximity to the marginal portion of a metallic vehicle closure such as an engine hood or trunk lid, the pick-up being used to detect surface high-frequency currents having a frequency above a predetermined level.

The prior art antenna system for detecting currents on the vehicle body is mainly intended to receive AM radio waves. For such a reason, the antenna system could not obtain a good performance of reception since the wavelength of the AM radio waves is too large. The inventors took notice of this frequency dependency and have provided an improved antenna system which can very efficiently detect currents on the vehicle body by utilizing radio waves belonging to frequency bands above FM frequency bands (normally, above 50 MHz).

The inventors also noticed that the high-frequency currents exhibit a distribution through which the level of the currents is very different from location to location on the vehicle body. The present invention is therefore characterized in that the high-frequency pick-up device is disposed at a vehicle portion at which the currents induced by radio waves have less noise and a higher density. In a preferred embodiment of the present invention, the vehicle portion is selected to be near the marginal portion of a metallic vehicle closure.

The present invention is further characterized in that the high-frequency pick-up is arranged along the marginal portion of the metallic vehicle closure within a distance of $12\times10^{-3}$ c/f(m) so that the high-frequency currents having the above frequency characteristic can positively be detected. The pick-up may be in the form of either a loop antenna for electromagnetically detecting a magnetic flux induced by currents on the vehicle body, an electrode type detector, for electrostatically detecting high-frequency signals by the use of electrostatic capacity formed between the electrode type detector and a metallic vehicle closure, or a sliding core and coil type detector.

In accordance with the present invention, the antenna system preferably comprises at least one high-frequency pick-up device disposed on the engine hood or trunk lid at one of its four corners or central position on the marginal portion on the side of the passenger room. Thus, the high-frequency pick-up device will be disposed at a vehicle location at which currents induced by radio waves have a higher density and less noise.

DETAILED DESCRIPTION OF PREFERRED EMBODIMENTS

Distribution of High-Frequency Currents

Referring now to FIGS. 9–17, there is illustrated a process of investigating a distribution of high-frequency currents on the vehicle body to determine a location at which an antenna can most efficiently operate.

Figure 9:
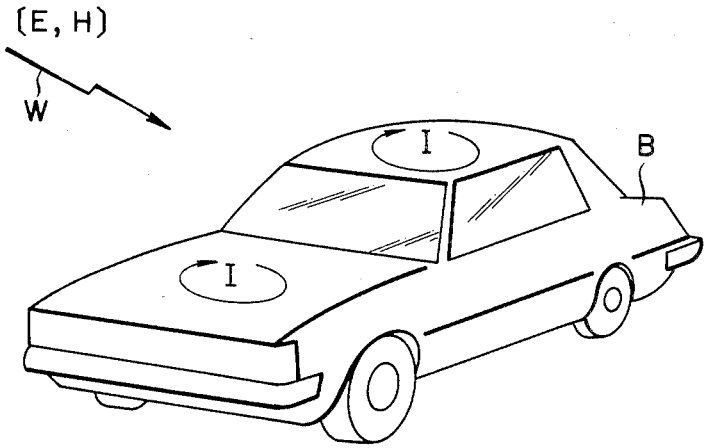
FIG. 9 illustrates surface currents I induced on the vehicle body B by external waves W.

FIG. 9 shows that when external waves W such as radio waves and the like pass through the vehicle body B of conductive metal material, surface currents I corresponding to the intensity of the waves are induced on the vehicle body at various locations. The present invention intends to use waves belonging to relatively high frequency bands above 50 MHz, such as FM bands, TV bands and others.

The present invention is characterized in that for such frequency bands, a distribution of induced currents on the vehicle body is measured to determine a location at which the density of surface currents is higher with less noise and on which a pick-up device is to be placed.

To determine the distribution of surface currents, a simulation is carried out by the use of a computer and also the intensity of current is actually measured at various locations. To this end, the present invention uses a probe functioning in accordance with the same principle as in a high-frequency pick-up mounted on the vehicle body at a desired location, as will be described hereinafter. The probe is moved through the entire surface of the vehicle body while changing the orientation of the probe at each of the locations.

Figure 10:
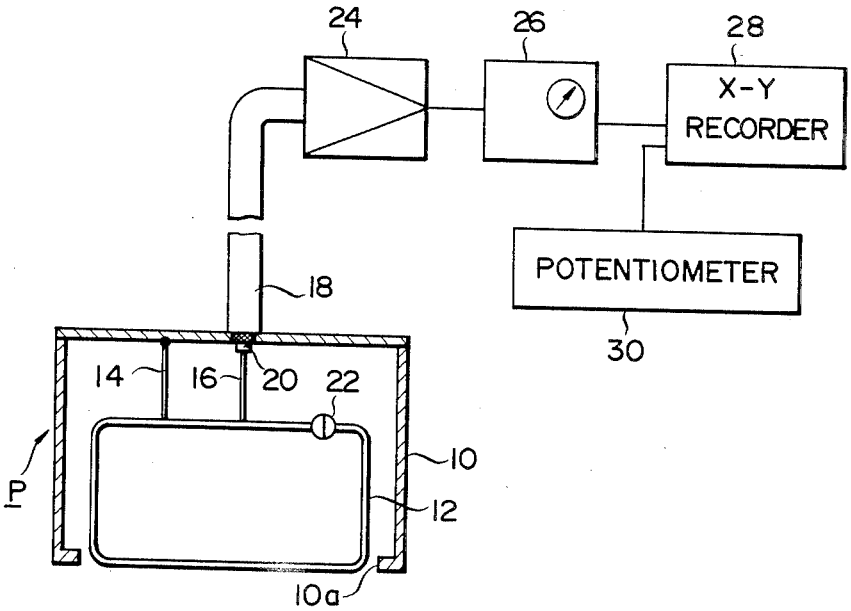
FIG. 10 illustrates a probe constructed and functioning in the same manner as in the high-frequency pick-up used in the present invention and its processing circuit all of which are used to determine a distribution of surface currents on the vehicle body.

FIG. 10 shows the schematic construction of a probe P constructed in accordance with substantially the same principle as in a high-frequency pick-up described hereinafter. The probe P comprises a case 10 of electrically conductive material and a loop coil 12 housed within the case 10 protect it from external waves not intended to be received. The case 10 has an opening 10*a* formed therein through which a portion of the loop coil 12 is externally exposed. The exposed portion of the loop coil 12 is positioned in close proximity to the surface of the vehicle body B to detect a magnetic flux induced by the surface currents on the vehicle body. The loop coil 12 is electrically connected with the case 10 through a short-circuiting line 14 and has an output terminal 16 connected with a core conductor 20 in a coaxial cable 18. The loop coil 12 also includes a capacitor 22 for causing the frequency of the loop coil 12 to resonate with a desired frequency to be measured to improve the efficiency of the pick-up device.

When the probe P is moved along the surface of the vehicle body B while changing the orientation thereof at each location, it is possible to accurately determine the distribution and orientation of surface currents induced on the surface of the vehicle body. The output of the probe P is amplified by means of a high-frequency voltage amplifier 24 with the amplified output signal being measured by means of a high-frequency voltage meter 26. The output voltage of the loop coil is read at the indicator of the meter 26 and at the same time recorded by an X-Y recorder 28 as a signal used to determine the distribution of surface currents on the vehicle body. The X-Y recorder 28 receives a signal indicative of each of various locations on the vehicle body from a potentiometer 30. In such a manner, the surface high-frequency currents will be determined at the respective locations on the vehicle body.

Figure 11:
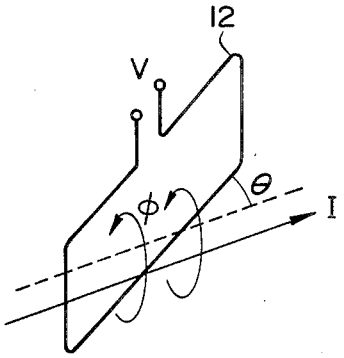
FIG. 11 illustrates the electromagnetic coupling relationship between the surface currents I and the loop antenna in the pick-up device.
Figure 12:
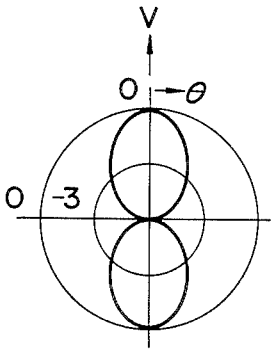
FIG. 12 is a diagram showing the directional pattern in the loop antenna shown in FIG. 11.

FIG. 11 shows a deviation 0 between the surface high-frequency currents I and the loop coil 12 of the probe. As seen from this figure, a magnetic flux $\phi$ induced by the currents I intersects the loop coil 12 to create a voltage to be detected V in the loop coil 12. If $\theta$ becomes zero, that is, the loop coil 12 is positioned parallel to the surface currents I as shown in FIG. 12, a maximum voltage is created. On the other hand, when the probe P is rotated at that location, the orientation of the surface currents I can be determined at the maximum voltage.

Figure 13:
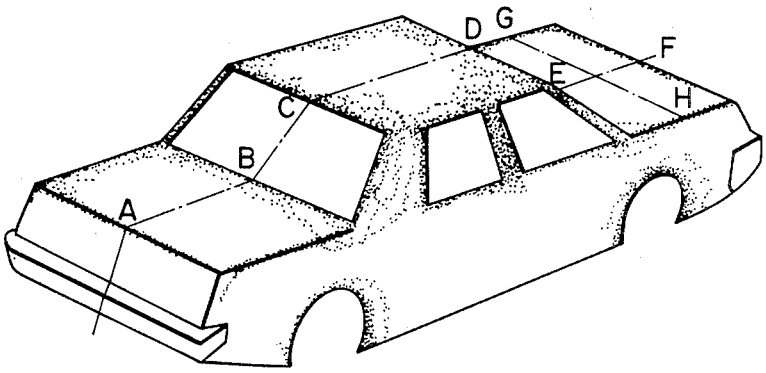
FIG. 13 illustrates a distribution of intensity in the surface currents.
Figure 14:
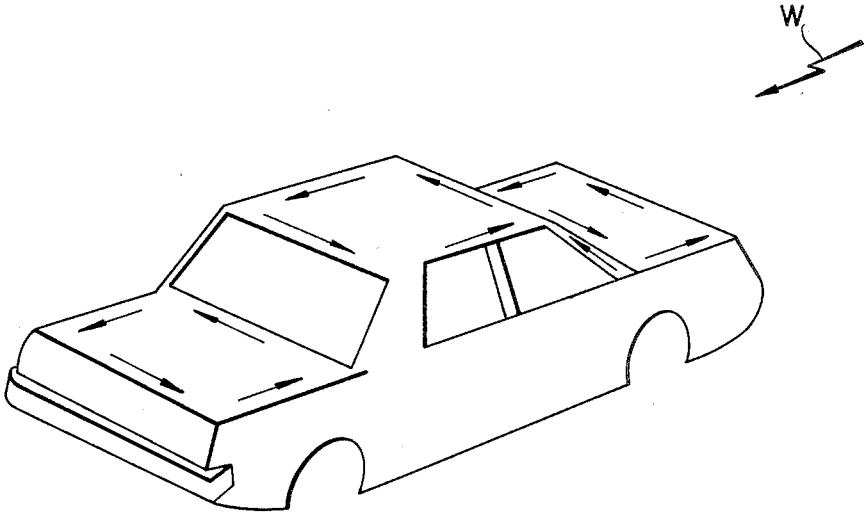
FIG. 14 illustrates the orientation of the surface currents.

FIGS. 13 and 14 respectively show the magnitude and orientation of surface high-frequency currents induced on various locations of the vehicle body by waves having a frequency of 80 MHz, these results being obtained by the measurement of the probe P and the simulation of the computer. As seen from FIG. 13, the density of the surface currents is higher at or near the marginal edge of each of flat members on the vehicle body and lower at the central portion of the same flat member.

It will be apparent from FIG. 14 that the surface currents flow parallel to each of the marginal edges on the vehicle body, that is, concentrate along each of the connections between the flat members.

Figure 15:
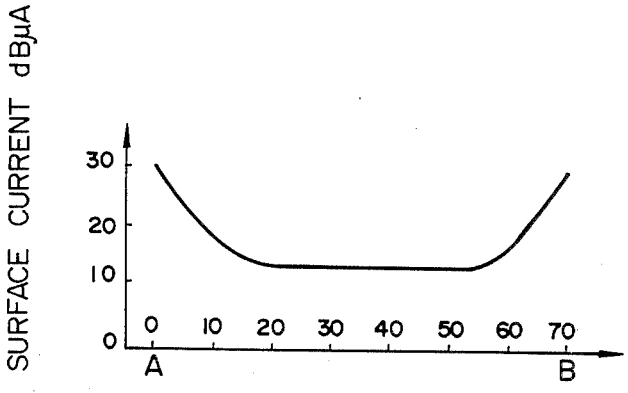
FIGS. 15, 16 and 17 are graphs each showing a distribution of surface currents along each of sections taken along a longitudinal axis shown in FIG. 13.
Figure 17:
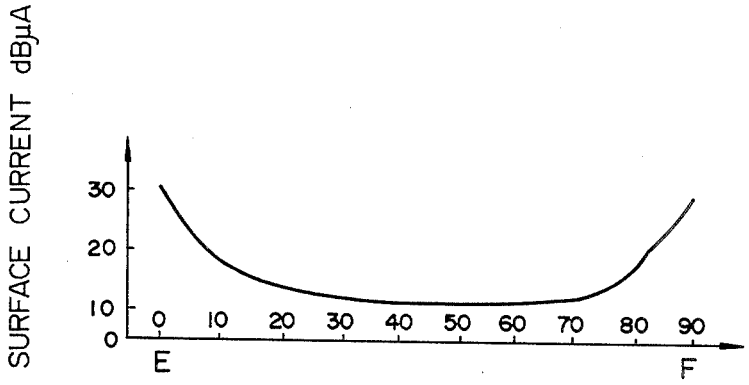
Figure 16:
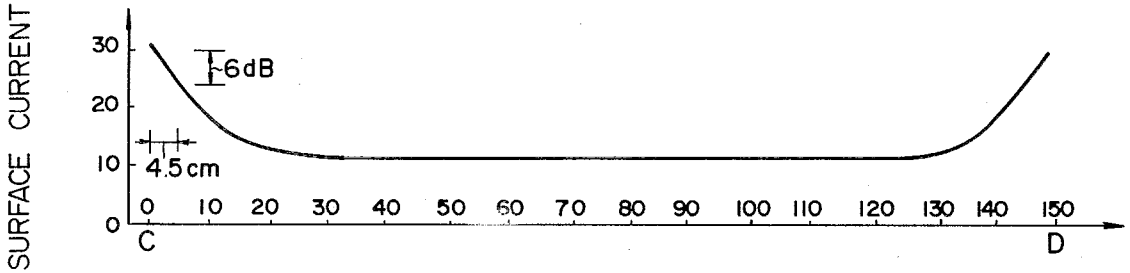

Studying a distribution of induced surface currents at each section along a longitudinal axis passing through substantially the central axis of the vehicle body as shown in FIG. 13, curves of distribution are obtained as shown in FIGS. 15–17.

FIG. 15 shows a distribution of surface currents at the trunk lid along a section A-B on the longitudinal axis. As seen from this figure, maximum currents flow at the opposite ends of the section A-B and decrease from the opposite ends to the central portion.

For the trunk lid, it is understood that if a high-frequency pick-up is located near the marginal edge thereof, the currents can concentrically be detected.

FIG. 16 shows a distribution of surface currents on the roof of the vehicle body while FIG. 17 shows a distribution of surface currents on the engine hood of the vehicle body. It will be apparent from these figures that the magnitude of the surface currents is maximum at the opposite ends of the roof or engine hood and decreases from the opposite ends toward the central portion.

Although the present invention has been described as to a high-frequency pick-up device located in close proximity to the marginal portion of the vehicle closure member with the length of the loop antenna thereof being parallel to the marginal portion, the sensitivity of the pick-up device can be improved by disposing the pick-up device spaced away from the marginal edge by a distance depending on the carrier frequency of radio waves to be received.

When the level of surface currents below 6 dB at which a good sensitivity can actually be obtained is considered, it is desirable to locate the pick-up device spaced away from the marginal edge within a distance of 4.5 cm to obtain a very good sensitivity.

From the results of various experiments and the simulation of the computer, it has been found that the practical spacing of the pick-up device from the marginal edge of the vehicle body depends on the carrier frequency of radio waves to be received. As the carrier frequency increases, this practical spacing is decreased.

Since the desirable spacing of the high-frequency pick-up device away from the marginal edge of a metallic vehicle closure (4.5 cm for the carrier frequency of 80 MHz) is inversely proportional to the level of the carrier frequency, a preferred distance within which the pick-up device is spaced away from the marginal edge of the vehicle body to obtain a good sensitivity for each of various carrier frequencies can be defined by:

$$12\times10^{-3}\ c/f(m)$$

where c is the velocity of light and f is a carrier frequency intended to be received.

For example, the high-frequency pick-up device may preferably be located on a vehicle closure member at a location spaced away from the marginal edge thereof by a distance of 3.6 cm for a carrier frequency of 100 MHz. As the carrier frequency f increases, the position of the high-frequency pick-up device will approach the marginal edge of the vehicle closure.

First Embodiment

Referring now to FIGS. 1–4, there is shown the first embodiment of a high-frequency pick-up device according to the present invention which is mounted on the marginal portion of a trunk lid.

Figure 2:
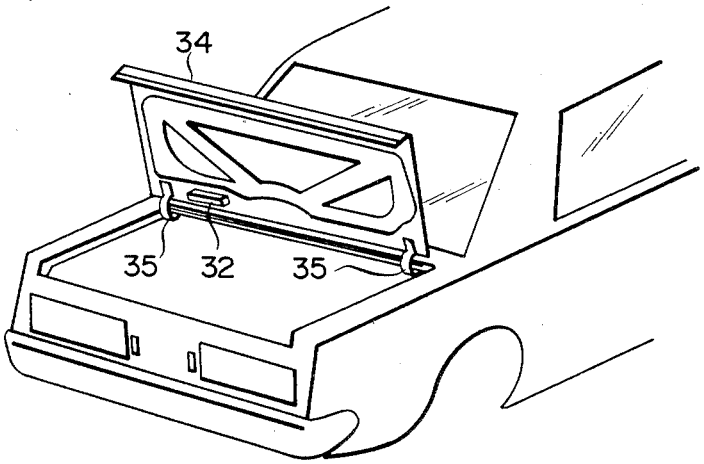
FIG. 2 is a schematic and perspective view showing the mounting of the pick-up shown in FIG. 1.

In FIG. 2, a high-frequency pick-up device 32 is in the form of an electromagnetic coupling type pick-up having a construction similar to that of the probe which includes the loop coil used to determine the distribution of surface currents on the vehicle body as described hereinbefore.

The trunk lid 34 is pivotally connected at one side with the vehicle body through hinges 35.

Figure 1:
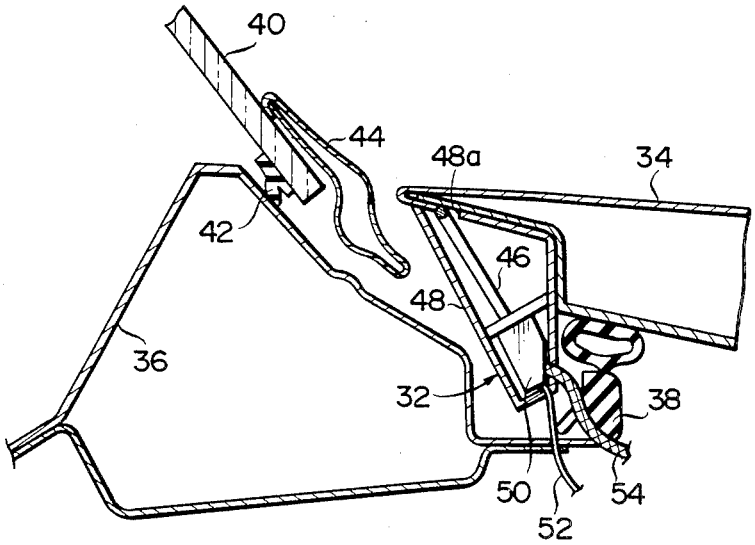
FIG. 1 is a cross-sectional view showing the primary part of the first preferred embodiment of an automobile antenna system according to the present invention, with a high-frequency pick-up used therein being in the form of an electromagnetic coupling type loop antenna which is fixedly mounted on the marginal portion of a trunk lid in the vehicle body.

FIG. 1 shows the details of the high-frequency pick-up device mounted on the trunk lid 34. As seen from FIG. 1, a weather watertight strip 38 is interposed between the trunk lid 34 and a rear tray panel 36 to prevent any external water from penetrating into the interior of the vehicle body.

An airtight dam 42 is interposed between the rear window glass 40 and the rear tray panel 36 to prevent any external water and noise from penetrating into the interior of the vehicle body. The lower margin of the rear window glass 40 is covered by a molding 44 in the well-known manner.

The first embodiment of the present invention is characterized in that the high-frequency pick-up device 32 is mounted on the marginal edge portion of the trunk lid 34 at a location opposed to the rear tray panel 36. The pick-up device 32 includes a loop antenna 46 contained therein and arranged such that the length thereof will be parallel to the longitudinal axis of the trunk lid 34.

It is to be noted that the loop antenna 46 should be spaced inwardly away from the marginal edge of the trunk lid 34 within a distance defined by $12\times10^{-3}$ c/f(m), e.g. within 4.5 cm for an FM radio wave having a carrier frequency of 80 MHz. Thus, the loop antenna 46 can positively and efficiently catch surface currents concentrically flowing on the marginal portion of the trunk lid 34.

Since the orientation of the surface currents is parallel to the marginal edge of the trunk lid as seen from FIG. 14, the loop antenna 46 should be arranged so that the length thereof will be parallel to the marginal edge of the trunk lid 34.

The high-frequency pick-up device 32 comprises a case 48 of electrically conductive material which contains said loop antenna 46 and a circuit section 50 including a pre-amplifier and other processing instruments. The case 48 is provided with an opening 48*a* faced to the trunk lid 34.

The loop antenna 46 contained within the case 48 can thus catch only a magnetic flux induced by the surface high-frequency currents flowing on the marginal portion of the trunk lid 34 and be positively protected from any other external magnetic flux by the case 48.

The loop antenna 46 is in the form of a single-winding antenna mounted along the marginal inward-turned portion of the trunk lid 34. The loop antenna 46 comprises an insulated winding which is electrically insulated from and placed in close contact with the trunk lid 34. Thus, the loop antenna 42 can intersect the magnetic flux induced by the surface currents on the trunk lid 34.

The circuit section 50 is supplied with power and signals for controlling it through a cable 52. High-frequency signals detected by the loop antenna 46 are fetched externally through a coaxial cable 54 and then processed by a circuit similar to that used in investigating the distribution of surface currents as described hereinbefore.

Thus, the first embodiment of the present invention provides an improved antenna system for automobiles, which can positively and efficiently receive radio waves of high frequency by the use of a high-frequency pick-up device for detecting surface high-frequency currents on the inside of the trunk lid on the vehicle body and which has no external projection on the vehicle body.

Figure 3:
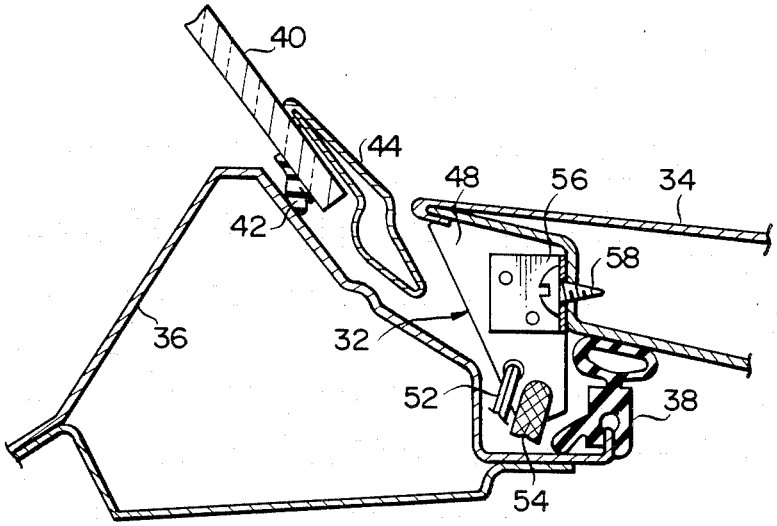
FIG. 3 illustrates the details of the mounting of the high-frequency pick-up used in the first embodiment of the present invention.

FIG. 3 shows the mounting arrangement of the high-frequency pick-up device 32 in the first embodiment of the present invention wherein parts similar to those of FIG. 1 are denoted by similar reference numerals.

As seen from FIG. 3, mounting brackets 56 (only one shown) are attached to the opposite sides of the case 48 in the high-frequency pick-up device 32. Each of the mounting brackets 56 is fastened to the inner panel of the trunk lid 34 by means of screws 58. Thus, the high-frequency pick-up device 32 is fixedly mounted on the inside of the trunk lid 34.

Figure 4:
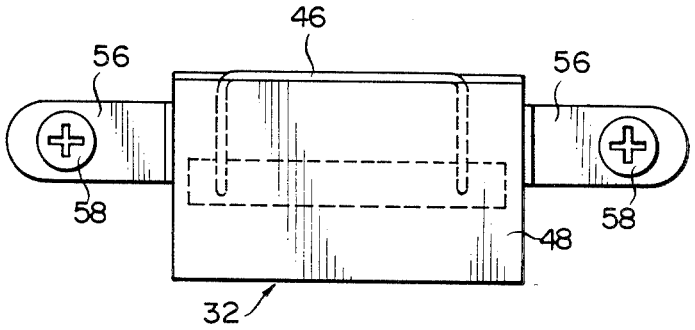
FIG. 4 is a view showing the outline of the high-frequency pick-up in the first embodiment of the present invention.
Figure 5:
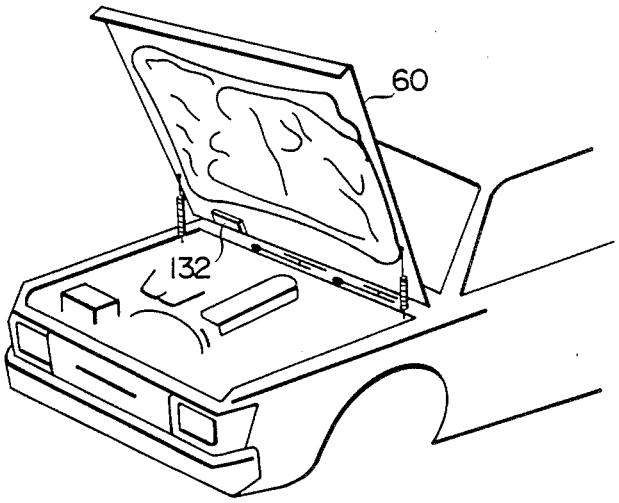
FIG. 5 is a perspective view illustrating the position of a pick-up which is the second preferred embodiment of the present invention.

One preferred form of the high-frequency pick-up device 32 is shown in FIG. 4.

Second Embodiment

Referring now to FIGS. 5–8, here is shown the second embodiment of the present invention which includes a high-frequency pick-up device mounted on an engine hood in close proximity to the marginal edge thereof.

Figure 6:
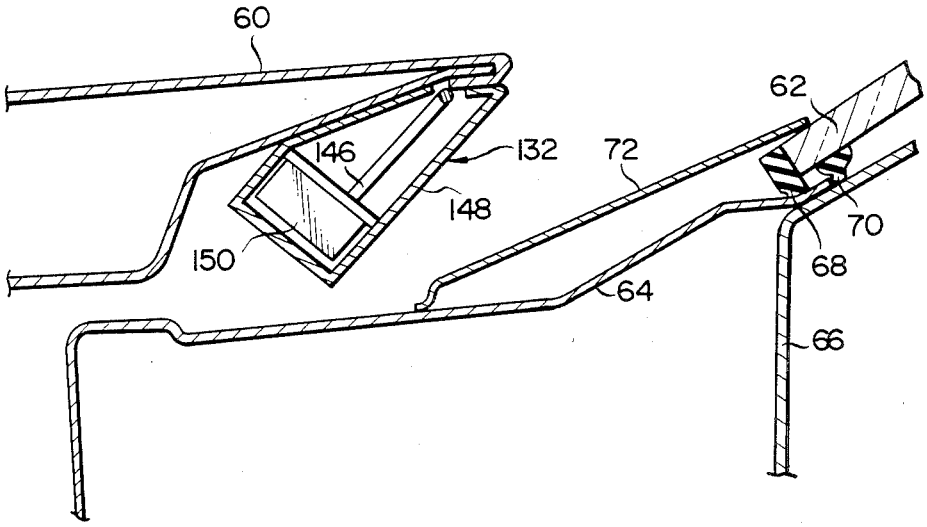
FIG. 6 is a cross-sectional view showing the primary part of an electromagnetic coupling type high-frequency pick-up mounted on an engine hood, which is the second embodiment of the present invention.

In FIG. 6, the engine hood 60 is pivotally connected with the vehicle body. When the engine hood 60 is in its closed position, the marginal edge thereof on the side of a windshield glass 62 is faced to a front outer panel 64. The inner wall of the front outer panel 64 is connected with a front inner panel 66. The windshield glass 62 is supported on the front outer panel 64 by means of a stopper 68. Between the windshield glass 62 and the front inner panel 66 is positioned a dam 70 for preventing any external water from penetrating into the interior of the vehicle body.

Moreover, the lower edge of the windshield glass 62 is covered by a molding 72 in the well-known manner.

The pick-up device 132 of the second embodiment has a construction similar to that of the first embodiment. Thus, parts similar to those in the first embodiment are designated by similar reference numerals but added by 100.

The second embodiment is characterized in that the high-frequency pick-up device 132 is mounted on the engine hood 60 at a location spaced inwardly away from the marginal edge thereof on the side of the front outer panel 64 within a distance of 4.5 cm. Thus, the pick-up device can positively detect surface high-frequency currents concentrically flowing along the marginal portion of the engine hood.

Figure 7:
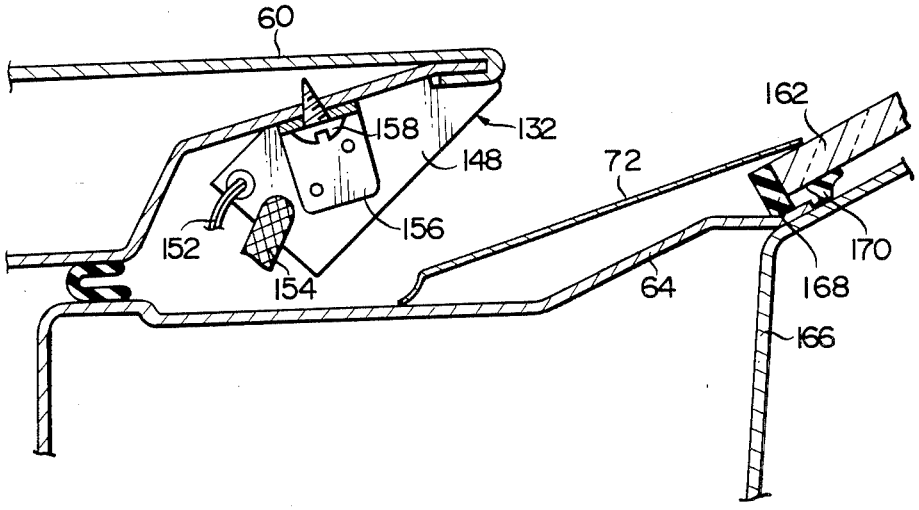
FIG. 7 illustrates the mounting of the high-frequency pick-up device in the second embodiment of the present invention.
Figure 8:
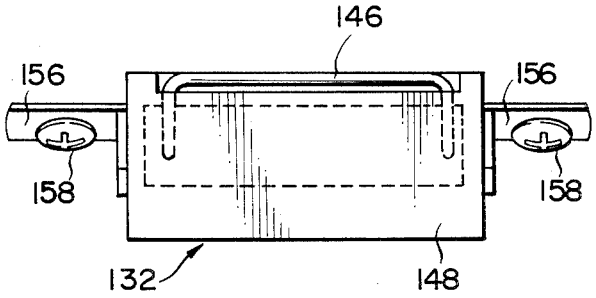
FIG. 8 is a view showing the outline of the high-frequency pick-up in the second embodiment of the present invention.

FIG. 7 shows the mounting of the high-frequency pick-up device 132 on the engine hood 60. FIG. 8 shows the outline of the high-frequency pick-up device to be mounted on the engine hood. This construction or arrangement is similar to that of the first embodiment and will not further be described.

It is further to be noted that the high-frequency pick-up device should be placed at such a location that it will not impede the motion of wiper blades.

Distribution of Noise Currents

As previously described, the proportion of noise to surface high-frequency currents on the vehicle body is very different from one location to another on the vehicle body. It is thus understood that if a high-frequency pick-up device is placed on the vehicle body at a location having less noise, the antenna system can be improved.

Figure 18:
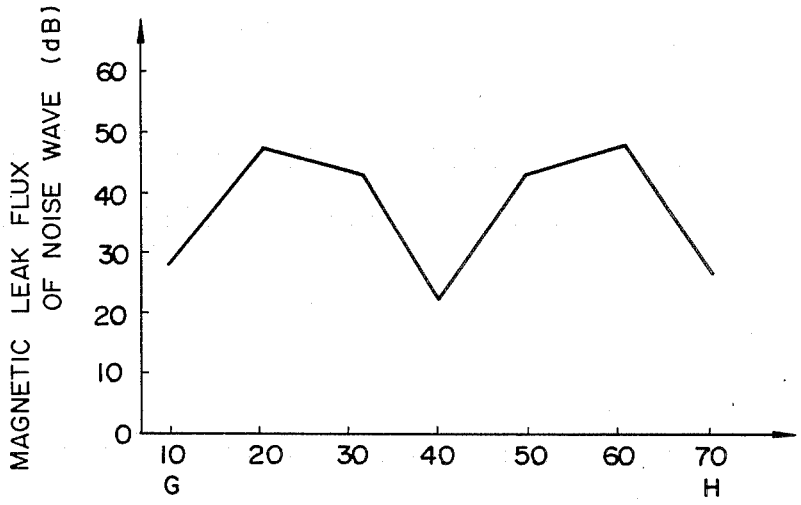
FIG. 18 is a graph showing a distribution of noise currents along a cross-sectional line G-H shown in FIG. 13.
Figure 19:
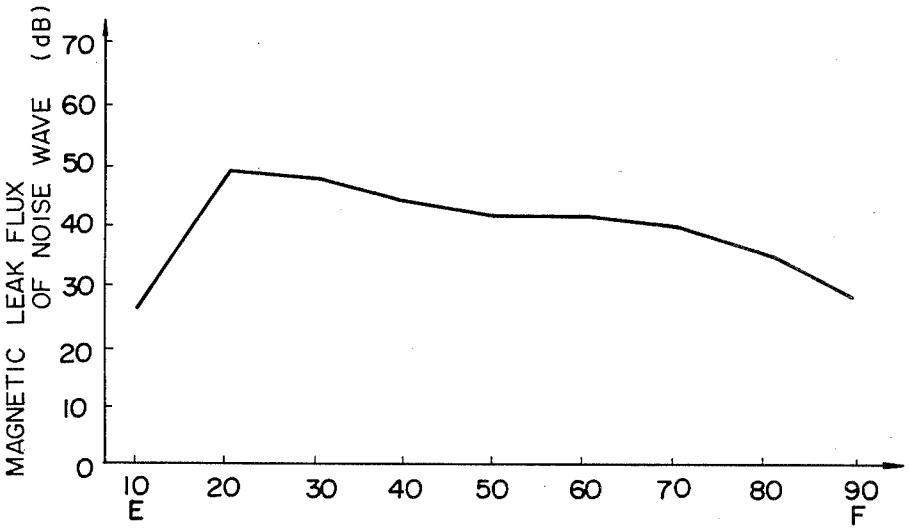
FIG. 19 is a graph showing a distribution of noise currents along a section E-F on the longitudinal line in FIG. 13.

Graphs of FIGS. 18 and 19 illustrate measurements relating to the distribution of noise currents. FIG. 18 shows a distribution of noise currents measured along a transverse line G-H in FIG. 13. As seen from FIG. 18, the level of noise currents is lower at the opposite sides or the central position on the transverse line. It is therefore desirable to mount the high-frequency pick-up device on the engine hood at one of the opposite sides or the central portion.

FIG. 19 shows a distribution of noise currents on the engine hood along a section E-F of the longitudinal axis in FIG. 13. As seen from this figure, the level of noise currents is minimum at the opposite ends of the section E-F.

In accordance with the present invention, accordingly, the following locations on the vehicle body are desirably selected for the reason that the level of surface high-frequency currents, induced by radio waves is higher with less noise currents:

Four corners on the engine hood (I, J, K and L in FIG. 20); and

Figure 20:
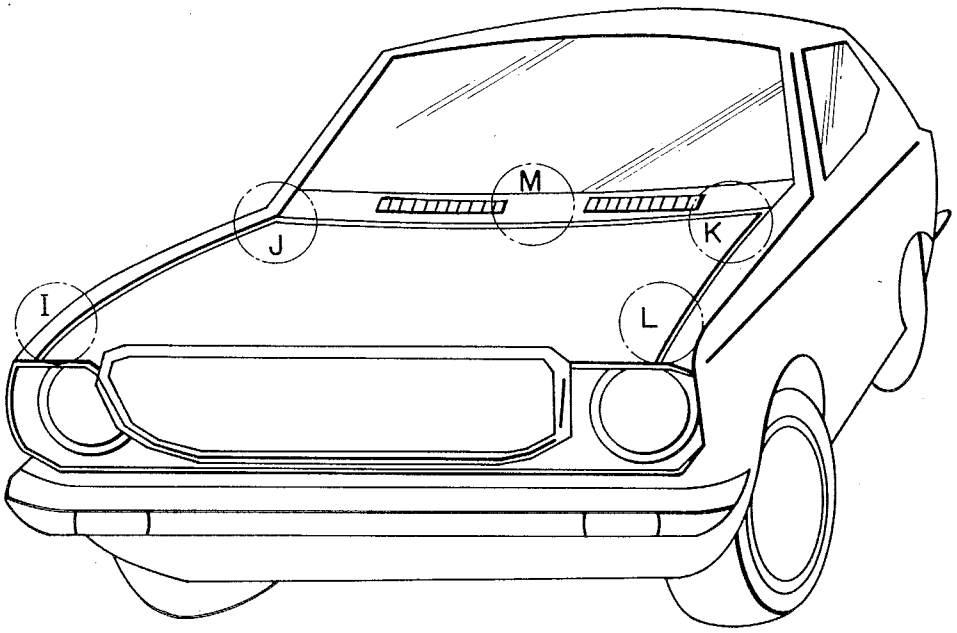
FIG. 20 illustrates other locations of the vehicle body on which the high-frequency pick-up device of the present invention can be disposed.

Central portion of the engine hood on the side of the passenger room (M in FIG. 20).

Although not described in detail hereinbefore, this is also true of the trunk lid on the vehicle body.

Third Embodiment

Referring now to FIGS. 21–24, there is shown the third embodiment of a high-frequency pick-up device mounted on the trunk lid in accordance with the principle of the present invention.

The high-frequency pick-up device 232 is of the electromagnetic coupling type and has a construction similar to that of a probe which includes a loop coil used to determine the distribution of surface currents on the vehicle body as previously described.

Trunk lid 234 is pivotally connected at one side with the vehicle body through trunk hinges 235.

Figure 21:
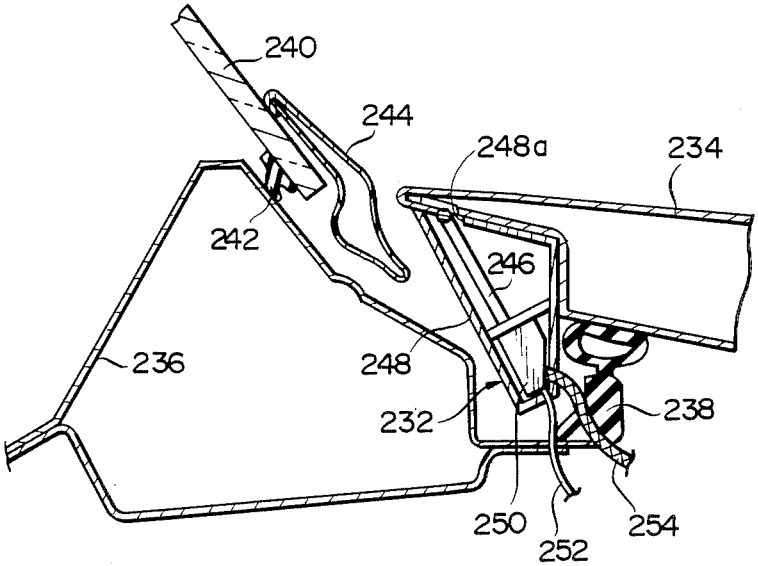
FIG. 21 is a cross-sectional view showing the primary part of an automobile antenna system which is the third preferred embodiment of the present invention, with the high-frequency pick-up device being in the form of an electromagnetic coupling type loop antenna mounted on a trunk lid at its central position on the side of the passenger room.
Figure 22:
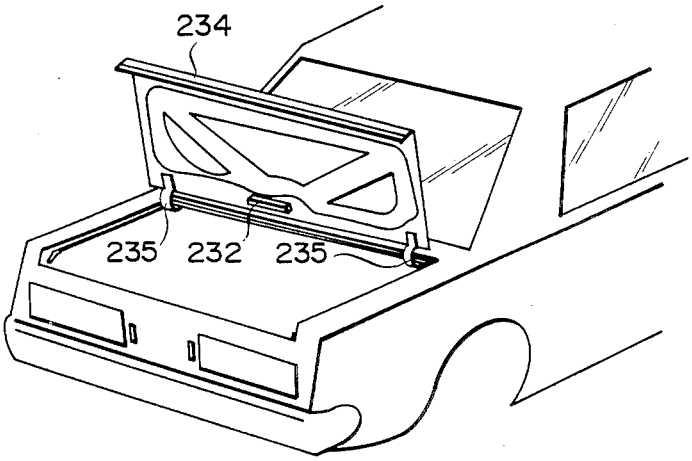
FIG. 22 is a schematic and perspective view showing the position of the pick-up device shown in FIG. 21.

FIG. 21 shows the details of the high-frequency pick-up device in the third embodiment which is mounted on the trunk lid 234. As seen from FIG. 21, a weather watertight strip 238 is interposed between the trunk lid 234 and a rear tray panel 236 to prevent any external water from penetrating into the interior of the vehicle body through a rear window glass 240.

Between the rear window glass 240 and the rear tray panel 236 is interposed a dam 242 for preventing any external water and noise from penetrating into the interior of the vehicle body. The lower margin of the rear window glass 240 is covered by a molding 244 in the well-known manner.

The third embodiment is characterized in that the high-frequency pick-up device 232 is fixedly mounted on the trunk lid 234 at its central portion faced to the rear tray panel 236 adjacent to the passenger room of the vehicle body. A loop antenna 246 contained within the pick-up device is so arranged that the length thereof will be parallel to the longitudinal axis of the trunk lid 234.

Furthermore, the loop antenna 246 is arranged on the trunk lid 234 at a location spaced inwardly away from the marginal edge thereof within a distance defined by $12\times10^{-3}$ c/f(m), e.g. within 4.5 cm for FM radio waves having a carrier frequency of 80 MHz. In such a manner, the present invention provides an antenna system including a loop antenna which can positively and efficiently catch surface currents concentrically flowing on the marginal portion of the trunk lid 234.

The high-frequency pick-up device 232 comprises a case 248 of electrically conductive material which contains said loop antenna 246 and a circuit section 250 including a pre-amplifier and other processing instruments. The case 248 is provided with an opening 248*a* faced to the trunk lid 234.

Thus, the loop antenna 246 housed within the case 248 can catch only a magnetic flux induced by surface high-frequency currents flowing on the marginal portion of the trunk lid 234 and be positively protected from any other external flux by the case 248.

The loop antenna 246 is a single-winding type positioned along the inwardly turned margin of the trunk lid 234. The loop antenna 246 is covered by insulation such that it can be electrically separated from and positioned in close contact with the trunk lid 234. As a result, a magnetic flux induced by surface currents can efficiently intersect the loop antenna 242.

The circuit section 250 receives power and control signals through a cable 252. High-frequency signals detected by the loop antenna 246 are supplied through a coaxial cable 254 to a processing circuit similar to that used to determine the distribution of surface currents as previously described.

Figure 23:
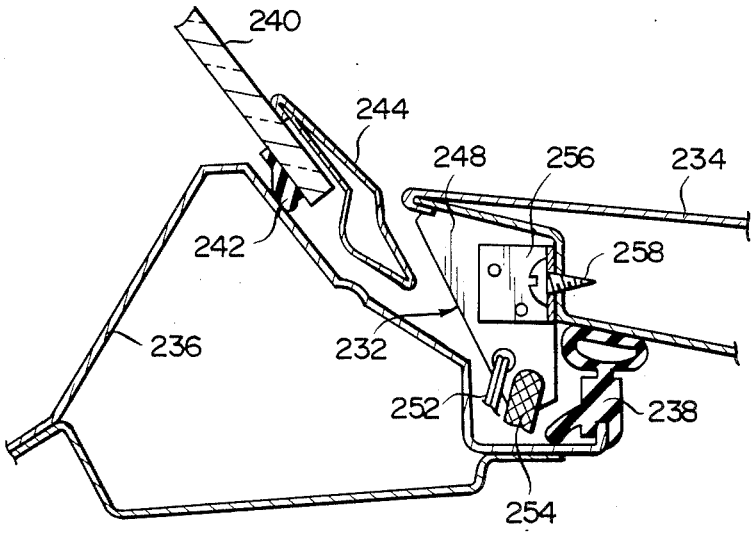
FIG. 23 is a schematic view of the mounting of the high-frequency pick-up in the third embodiment of the present invention.

FIG. 23 shows the mounting of the high-frequency pick-up device 232 on the trunk lid 234 in the third embodiment, in which parts similar to those shown in FIG. 21 are denoted by similar reference numerals.

As seen from FIG. 23, mounting brackets 256 (only one shown) are attached to the opposite sides of the high-frequency pick-up device 232 by means of bolts or the like. Each of the mounting brackets 256 is fastened to the inner wall of the trunk lid 234 by means of screws 258 (only one shown) to mount the high-frequency pick-up device 232 on the inside of the trunk lid 234.

Figure 24:
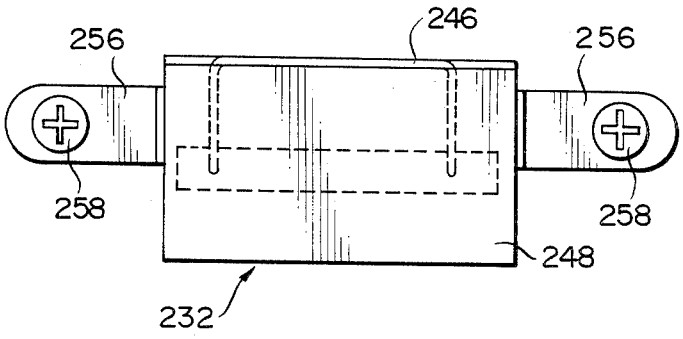
FIG. 24 is a view showing the outline of the high-frequency pick-up device in the third embodiment of the present invention.
Figure 25:
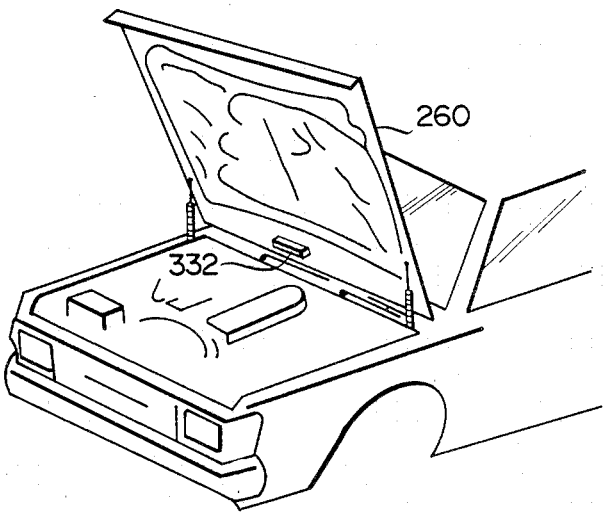
FIG. 25 is a schematic and perspective view showing the position of a pick-up device which is the fourth embodiment of the present invention.

It is thus preferred that the high-frequency pick-up device 234 has such an outline as shown in FIG. 24.

Fourth Embodiment

Referring now to FIGS. 25–28, there is shown the fourth embodiment of the present invention which includes a high-frequency pick-up device mounted on an engine hood.

Figure 26:
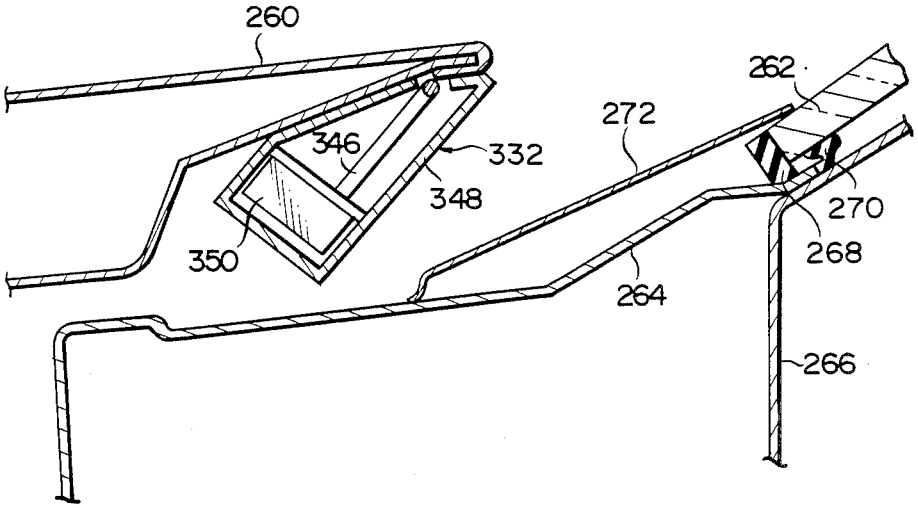
FIG. 26 is a cross-sectional view showing the primary part of the electromagnetic coupling type high-frequency pick-up device according to the fourth embodiment of the present invention, which is mounted on an engine hood at its central position on the side of the passenger room.

As seen from FIG. 26, the engine hood 260 is pivotally connected at one side with the vehicle body by means of hinges. When the engine hood is closed, the marginal portion thereof on the side of a windshield glass 262 is faced to a front outer panel 264. The inner wall of the front outer panel 264 faced to the passenger room is connected with a front inner panel 266. The windshield glass 262 is supported on the front outer panel 264 by means of a stopper 268. Between the windshield glass 262 and the front inner panel 266 is located a dam 270 for preventing any external water from penetrating into the interior of the vehicle body.

The lower margin of the windshield glass 262 is covered by a molding 272 in the well-known manner.

In the fourth embodiment, the high-frequency pick-up device 332 has a construction similar to that of the third embodiment, in which parts similar to those of the third embodiment are designated by similar reference numerals but added by 100.

The fourth embodiment is characterized in that the high-frequency pick-up device 332 is mounted on the engine hood 260 at its central portion faced to the front outer panel 264 on the side of the passenger room within 4.5 cm measured inwardly from the marginal edge of the engine hood. Thus, the antenna system can positively detect surface high-frequency currents concentrically flowing on the marginal portion of the engine hood with less noise.

Figure 27:
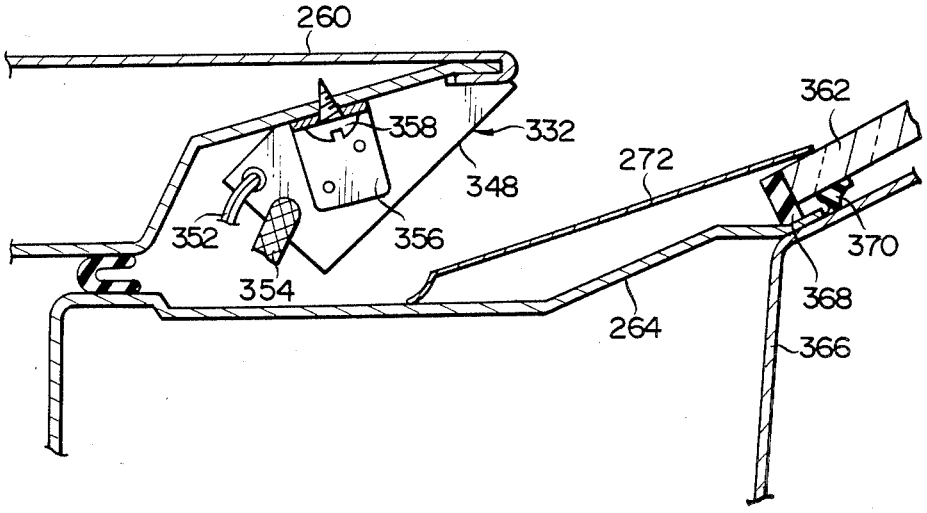
FIG. 27 is a schematic view showing the mounting of the high-frequency pick-up device in the fourth embodiment of the present invention.
Figure 28:
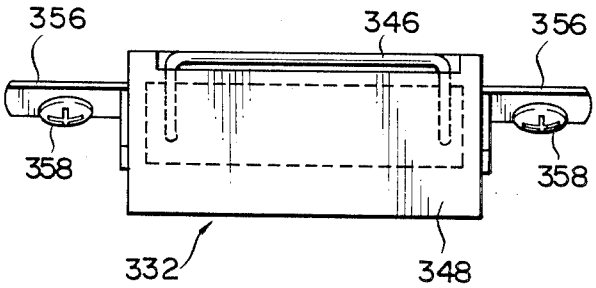
FIG. 28 is a view showing the outline of the high-frequency pick-up device in the fourth embodiment of the present invention.

FIG. 27 shows the mounting of the high-frequency pick-up device 332 in the fourth embodiment on the engine hood 260. FIG. 28 shows the outline of the high-frequency pick-up device mounted on the engine hood. The mounting arrangement is similar to that of the third embodiment and will not further be described.

In the fourth embodiment, it is to be noted that the high-frequency pick-up device should be placed at such a location that the operation of wiper blades will not be impeded by the mounting brackets on the high-frequency pick-up device.

Although the third and fourth embodiments have been described as to the high-frequency pick-up device mounted on a vehicle closure at its central portion on the side of the passenger room, the high-frequency pick-up device may similarly be located on one of four corners of the vehicle closure.

Although the present invention has been described as to the electromagnetic coupling type pick-up, it may similarly utilize an electrostatic coupling type pick-up. For the electrostatic coupling type pick-up, a detection electrode is disposed longitudinally along the marginal portion of a metallic vehicle closure member through an air gap or an insulation plate to form an electrostatic capacity between the surface of the closure member and the detection electrode. Surface high-frequency currents are fetched by the detection electrode through the electrostatic capacity.

In accordance with the principle of the present invention, moreover, a ferrite core and coil type pick-up device may be utilized which is mounted on a vehicle closure member such as an engine hood or trunk lid so that the length of the ferrite core is disposed parallel to and in close proximity to the marginal edge of the vehicle closure member. Induced currents may be fetched by a coil wound about the ferrite core.

We claim:

1. An automobile antenna system for detecting surface high-frequency currents, induced by broadcast waves on a vehicle body of an automobile having an engine and concentrated into marginal edges of the vehicle body, said antenna system comprising:

a case made of electrically conductive material and having an opening along one side thereof;

high-frequency pick-up means, having a length and a width, being disposed within said case with the length opposite the opening and being provided for detecting the surface high-frequency currents induced on any one of a marginal edge of the engine hood and a marginal edge of the trunk lid and being located at a position spaced inwardly away from said any one of the marginal edge of the engine hood and the marginal edge of the truck lid within a distance defined by :

$$12\times10^{-3}\ c/f(m)$$

where c is the velocity of light in meters per second and f is a carrier frequency of the radio waves in cycles per second; and mounting means for mounting said case containing said high-frequency pick-up means with the length of said high-frequency pick-up means being arranged parallel and in close proximity to said any one of the marginal edge of the engine hood and the marginal edge of the trunk lid.

2. An automobile antenna system as defined in claim 1 said high-frequency means being an electromagnetic coupling type pick-up.

3. An automobile antenna system as define in claim 1 said high-frequency pick-up means being mounted on the marginal edge of the trunk lid faced to a rear tray panel on the vehicle body and said high-frequency pick-up means comprising a loop antenna arranged with the length parallel to the longitudinal axis of the trunk lid.

4. An automobile antenna system as defined in claim 1 said high-frequency pick-up means being an electrostatic coupling type pick-up.

5. An automobile antenna system as defined in claim 4, said high-frequency pick-up means comprising detection electrode means disposed apart from said any one of the marginal edge of the engine hood and the marginal edge of the trunk lid to for an electrostatic capacity between the surface of said any one of the marginal edge of the engine hood and the marginal edge of the trunk lid and said electrode means, whereby surface high-frequency currents can be detected by said detection electrode means through said electrostatic capacity.

* * * * *